US006604915B1

(12) United States Patent
Lindler et al.

(10) Patent No.: US 6,604,915 B1
(45) Date of Patent: Aug. 12, 2003

(54) COMPACT, HIGH EFFICIENCY, SMART MATERIAL ACTUATED HYDRAULIC PUMP

(75) Inventors: Jason E. Lindler, Mountain View, CA (US); Eric H. Anderson, Mountain View, CA (US); Marc Regelbrugge, Redwood City, CA (US)

(73) Assignee: CSA Engineering, Inc., Mountain View, CA (US)

( * ) Notice: Subject to any disclaimer, the term of this patent is extended or adjusted under 35 U.S.C. 154(b) by 0 days.

(21) Appl. No.: 10/101,384

(22) Filed: Mar. 20, 2002

(51) Int. Cl.[7] ..... F04B 17/00; F04B 9/08

(52) U.S. Cl. ..... 417/322; 417/413.2; 417/383

(58) Field of Search ..... 417/322, 413.1, 417/413.2, 383, 44.9

(56) References Cited

U.S. PATENT DOCUMENTS

| | | | | | |
|---|---|---|---|---|---|
| 3,598,506 | A | * | 8/1971 | O'Neill | 417/383 |
| 4,030,495 | A | | 6/1977 | Virag | |
| 4,708,600 | A | | 11/1987 | AbuJudom, II et al. | |
| 4,738,493 | A | | 4/1988 | Inagaki et al. | |
| 4,795,317 | A | | 1/1989 | Cusack | |
| 4,795,318 | A | | 1/1989 | Cusack | |
| 4,939,405 | A | * | 7/1990 | Okuyama et al. | 417/413.2 |
| 4,983,876 | A | | 1/1991 | Nakamura et al. | |
| 5,378,120 | A | * | 1/1995 | Taig | 417/322 |
| 5,641,270 | A | | 6/1997 | Sgourakes et al. | |
| 5,915,925 | A | * | 6/1999 | North, Jr. | 417/36 |
| 6,116,866 | A | * | 9/2000 | Tomita et al. | 417/413.2 |
| 6,282,908 | B1 | * | 9/2001 | Weldon | 417/332 |

FOREIGN PATENT DOCUMENTS

| | | | | |
|---|---|---|---|---|
| JP | 59-87286 | * | 5/1984 | 417/322 |

OTHER PUBLICATIONS

Development of a Compact Piezoelectric–Hydraulic Hybrid Actuator by Sirohi, Jayant and Chopra, Inderjit, Dept. of Aerospace Engineering, University of Maryland, Mar. 15, 2001.

Magnetostrictive Water Pump by Gerver, M.J. et al., SatCon Technology Corporation, Mar. 1998, SPIE Conference on Smart Structures and Integrated Systems, San Diego, CA.

Piezoelectric Hydraulic Pump, by Mauck, Lisa and Lynch, Christopher S., Georgia Institute of Technology, SPIE Conference on Smart Structures and Integrated Systems, Mar. 1999, Newport Beach, CA.

* cited by examiner

*Primary Examiner*—Charles G. Freay
*Assistant Examiner*—Michael K. Gray
(74) *Attorney, Agent, or Firm*—Rick G. Brewster

(57) ABSTRACT

The invention disclosed is a compact, high efficiency, smart material element driven hydraulic pump comprising a diaphragm, a face plate coupled to and spanning across the diaphragm, and a smart material element. The diaphragm comprises on a first side a recess and a stiff face-seal surface surrounding the recess. On the second side of the diaphragm is a stiff center pedestal and a flexure means attached to the periphery of the center pedestal. The diaphragm and face plate coupled together form a chamber that is dynamically sealed by contact of the face-seal surface against the face plate and such chamber's compliance is primarily and effectively within the flexure means within the diaphragm. A smart material element is positioned and constrained against the stiff center pedestal such that extension and contraction of the smart material element deforms the diaphragm such that the pumping chamber compresses and expands through compliance and deformation within the flexure means alone. In a preferred form the flexure means is comprised of two annular flexures and the recess is of conical edge shape such that the chamber flattens against the face plate to effect a broad, low profile pump chamber having negligible seal compliance and providing high volumetric efficiency.

24 Claims, 8 Drawing Sheets

COMPACT, HIGH EFFICIENCY, SMART MATERIAL ACTUATED HYDRAULIC PUMP

STATEMENT REGARDING FEDERALLY SPONSORED RESEARCH

This invention was made with U.S. Government support under Contract No. F33615-00-C-3026 awarded by the Air Force Research Laboratory. The U.S. Government has certain rights in this invention.

BACKGROUND OF THE INVENTION

The present invention relates to hydraulic pumps. More particularly, the present invention pertains to a compact, smart material element driven pump capable of power output significantly beyond that available in the prior art.

Smart materials are materials that respond with a change in shape and/or change in material characteristic upon application of externally applied driving forces. Shape changing smart material elements such as those made of piezoelectric, magnetostrictive, electrostrictive or similar materials are conceptually capable of serving as the force and motion inducing mechanism in actuators and fluid pumps. These smart materials convert energy stored in electric or magnetic fields to mechanical forces and motions. Very high force can be exerted by a small actuator and controlled very rapidly, in the 1 kHz frequency range and above. However, one significant drawback of smart material actuators has been the very small displacements afforded. Devices utilizing a single stroke of the smart material element for actuation find limited use. Various displacement amplification means have been employed such as levers and various nesting schemes. Displacement amplifications of 2 to 10 times may be achieved but the overall displacement remains very small and force output is greatly reduced. As a result, the useful mechanical work output from the device is insufficient for many applications.

Recent work in the smart materials community has described the concept of a smart material actuator driving a pump in a step and repeat type fashion, that is where a small quantity of fluid is drawn into a chamber and expelled at higher pressure in a rapidly repeated fashion so to supply the necessary large volume of fluid to a large stroke actuator. Such a device has been described by Mauck and Lynch in a paper presented at the SPIE Conference on Smart Structures and Integrated Systems in March 1999. The approach therein utilized a piezoelectric element to drive a piston in a sleeve with the piston sealed with an o-ring. Relatively low pump drive rates and flows were achieved, however.

A magnetostrictive water pump was developed for NASA by Gerver, et al., and is reported in a paper presented at the SPIE Conference on Smart Structures and Integrated Systems in March 1998. O-ring sealing of a sliding piston was employed. A pump with power efficiency of only 1–2% was achieved and at very low fluid working pressure (5 psi).

A pump developed by Sirohi and Chopra of the University of Maryland utilizes a piston displacing a diaphragm spanning across the inner diameter of a cylinder so to compress fluid within a cylindrical chamber where fluid is controlled to be expelled and drawn in through the use of ball check valves. Pumping frequency was limited to around 250 Hz due to valve dynamics.

The above mentioned work has not achieved the higher flow and large power (50–500 W) in a compact design that is necessary for stand alone actuator requirements, such as for driving the aerodynamic control surfaces of an aircraft.

The patent prior art similarly fails to achieve compact, high power performance. A major reason is that smart material driven actuator drive frequencies remain severely limited and far below the drive frequency potential of the smart material element. U.S. Pat. No. 4,983,876 discloses a piezoelectric pump assembly where a piezoelectric element drives a motion amplification lever which in turn drives a diaphragm at the end of a cylindrical chamber which has ball or poppet style check valves. The significant mass and compliance in the amplification mechanism limits the operational frequency of the device to around 35 Hz, thus substantially under utilizing the high frequency drive capability of piezoelectrics. Additionally, the cylindrical pumping chamber of this device limits the volumetric pumping efficiency.

Volumetric pumping inefficiency is common to the devices of the prior art. A magnetostrictive pump is disclosed in U.S. Pat. No. 4,795,318 where a magnetostrictive element drives an o-ring sealed piston to pump fluid across ball/spring check valves. Pumping efficiencies and pumping frequencies remain relatively limited by the compliance of the o-ring seals associated with the sliding piston and the low operational frequency associated with ball check valves. U.S. Pat. No. 5,641,270 discloses a magnetostrictive pump wherein a magnetostrictive element drives a diaphragm in a cylindrical chamber which further includes a bellows. The working fluid compressed in the chamber further compresses the bellows which pumps a second fluid. Volumetric inefficiency of the cylindrical chamber and uncontrolled deformations in the diaphragm due to diaphragm membrane and bending compliances significantly diminish the volumetric pumping efficiency of the device.

The usefulness of the devices of the prior art has been limited by their low flow and low power capability and/or lack of compactness due to low operating efficiencies. There remains a need for a self-contained, electrically driven, compact, high power hydraulic pump. Such a device would allow applications to eliminate the routing of high pressure hydraulic fluid from a central reservoir to a hydraulic actuator. The invention described herein provides for such a device.

BRIEF SUMMARY OF THE INVENTION

The invention disclosed is a compact, piezoelectric or other smart material element driven pump capable of power output significantly beyond that available in the prior art. The invention achieves both a volumetric pumping efficiency and pumping frequency substantially higher than that available from smart material driven pumps of the prior art, and further, the invention combines these attributes in a compact, high power density package.

The invention combines a novel, compliance controlled pumping chamber and actuator drive construction such that the smart material element yields significantly higher volumetric pumping efficiency, i.e. the ratio of pumping chamber volume change divided by original pumping chamber volume, than that available from devices of the prior art. In the embodiments of the invention, the pumping chamber volume change and consequent pumping occurs without the sliding motion common to piston and sleeve pumps and without the effective compliance of o-ring seals or other compliant seals common to other smart material driven pumps of the prior art.

In a preferred embodiment of the invention, a diaphragm plate comprised of a stiff center pedestal is surrounded by two concentric annular flexures which provide sufficiently low bending stiffness to the diaphragm for pumping deformation. The stiff center pedestal and concentric flexure combination provide diaphragm elasticity without the unwanted and efficiency wasting compliances of devices of the prior art. Further, in a preferred embodiment, the diaphragm plate includes a shallow, conical edged recess which flattens against a face plate. A face-seal surface of a stiff material surrounds the recess and serves as an effective seal between the diaphragm plate and face plate during pumping. The effect is a broad, low profile pump chamber with negligible seal compliance. This combination of controlled diaphragm compliance, conical edge shaped pumping chamber, and stiff face-seal dynamic sealing maximizes the volumetric efficiency in each pump cycle. This in turn maximizes pressure increase and flow during pumping for a given stroke length of the smart material element. Further in the embodiment, the smart material element presses directly against the stiff center pedestal in the center of the diaphragm plate so to minimize the compliance between the smart material element and diaphragm. The extension and contraction motion of the smart material element is thereby directly imparted to the diaphragm with negligible loss of motion.

The invention combines high volumetric pumping efficiency and concomitant high pumping pressure with a pumping frequency capability substantially higher than that available in the prior art. In a preferred embodiment, reed valves of very high resonant frequency are utilized as check valves to control passively the fluid flow into and out of the pumping chamber and afford high pumping frequency. Further the absence of o-ring seal compliance or other unwanted chamber compliances upon the dynamics of the pumping chamber provides for high frequency fluid pumping.

In a further embodiment the invention provides for a self-contained actuator through the direct combination of a hydraulic actuator, smart material driven pump, and associated hydraulic valves and accumulators.

BRIEF DESCRIPTION OF THE DRAWINGS

The operation of this invention can be best visualized by reference to the following drawings described below.

DETAILED DESCRIPTION OF THE INVENTION

Described in detail below is a compact, high power, smart material element driven hydraulic pump. In the description, for purposes of explanation, numerous specific details are set forth in order to provide a thorough understanding of the present invention. It will be obvious, however, to one skilled in the art that the present invention may be practiced without these specific details.

In an embodiment of the invention a diaphragm and a face plate spanning across the diaphragm are coupled together to form a pumping chamber. In the embodiment the diaphragm is constructed such that on the chamber or fluid side is a recess which is surrounded by a face-seal surface. The face-seal surface is of a stiff material such that negligible compliance exists. The face-seal surface is compressed against the face plate such that the chamber formed between the diaphragm and face plate is dynamically sealed with negligible compliance. Further in the embodiment, on the back side of the diaphragm, a center pedestal is constructed which is surrounded by a flexure means. A smart material element is positioned and constrained against the center pedestal such that extension and contraction of the smart material element deforms the diaphragm. The chamber is thereby forced to compress and expand through compliance within the flexure means. In a preferred form, the recess is of conical edge shape such that deformation of the diaphragm by the smart material element causes the chamber to flatten against the face plate so to maximize the volumetric efficiency when compressing the chamber. The smart material element utilized in the invention is of piezoelectric, magnetostrictive, electrostrictive or similar material.

In the invention inlet and outlet ports are provided in the face plate and/or diaphragm and are regulated by check valves to control fluid in-flow and out-flow from the pumping chamber. In one embodiment reed valves are placed over the inlet and outlet ports to provide passive flow control through the pumping chamber. The reeds are constructed such to have a high natural vibration frequency so to afford high frequency operation of the pumping chamber. In another embodiment the check valves are actively controlled check valves such that the check valves control flow through the inlet and outlet ports in phase controlled relationship to fluid pressure in the pumping chamber. In another embodiment inlet check valves are arrayed around the stiff center pedestal in the diaphragm, and outlet check valves, active and/or passive, are arrayed in circular pattern in the face sheet around the longitudinal axis of the pump.

The invention further incorporates an o-ring to statically seal the pumping chamber from leakage. The o-ring surrounds the face-seal surface and is thereby positioned outside of the pumping chamber so to provide static sealing but without adding effective compliance to the chamber during pumping.

Figure 1:
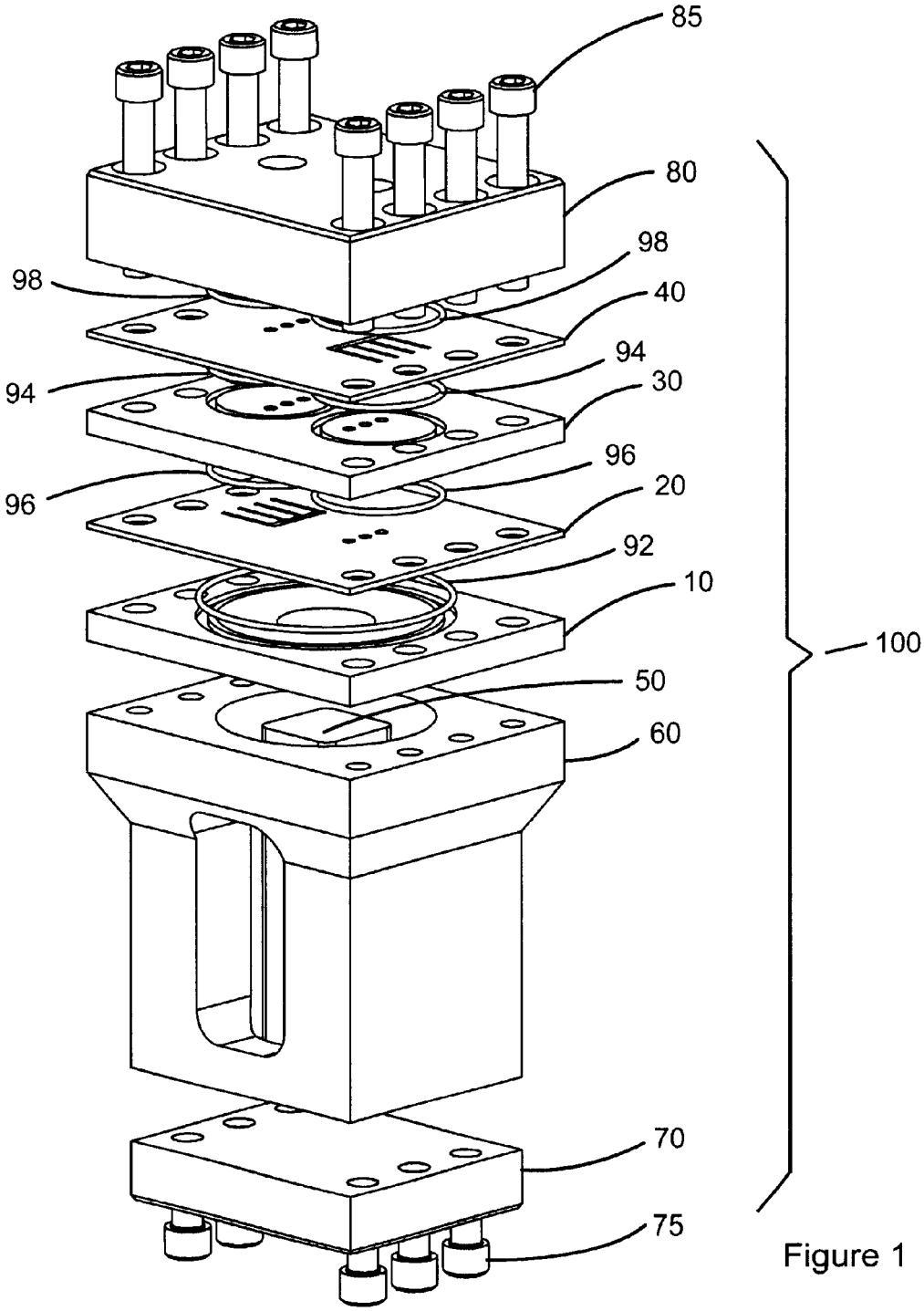
FIG. 1 is an exploded view of a smart material element actuated pump in accordance with an embodiment of the invention.

FIG. 1 depicts an exploded view of a smart material actuated pump 100 in accordance with an embodiment of the invention. A diaphragm plate 10, an inlet valve plate 20, a duct plate 30, and an outlet valve plate 40 lay against one another in a serial stack of plates such that a pump chamber and passive valve system is effected. This series of plates is constrained to a pump base 60 which houses smart material element 50. Base plate 70 and fasteners 75 support the bottom of smart material element 50 to be constrained against diaphragm plate 10. Top plate 80 and fasteners 85 constrain and sandwich diaphragm plate 10, inlet valve plate 20, duct plate 30, and outlet valve plate 40 together and against pump base 60. O-ring 92 provides a static fluid seal between diaphragm plate 10 and inlet valve plate 20, o-rings 96 provide static fluid seal between inlet valve plate 20 and duct plate 30, o-rings 94 provide static fluid seal between duct plate 30 and outlet valve plate 40, and o-rings 98 provide static fluid seal between outlet valve plate 40 and top plate 80.

Figure 2:
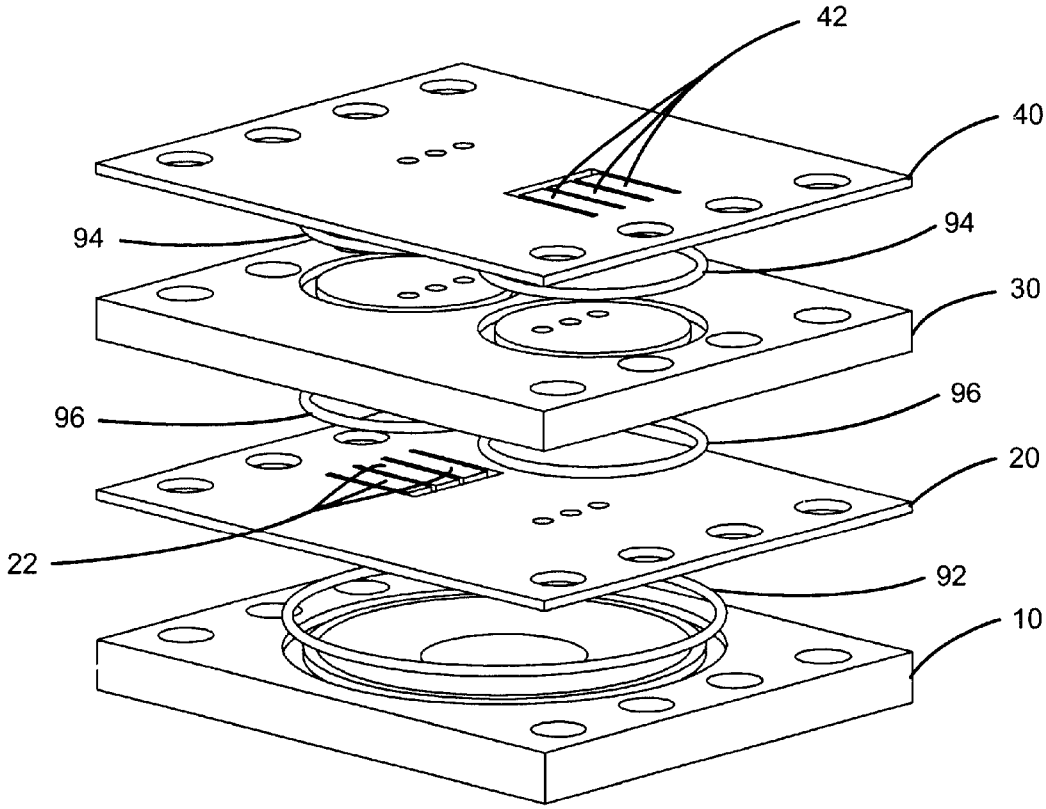
FIG. 2 is an exploded view of the chamber and valve plate portion of the smart material element actuated pump of FIG. 1 in accordance with an embodiment of the invention.

FIG. 2 shows an enlarged exploded view of the diaphragm plate 10, inlet valve plate 20, duct plate 30, and outlet valve plate 40 with o-rings 92, 94, and 96. The inlet valve plate 20 is further comprised of reed valves 22, and outlet valve plate 40 is further comprised of reed valves 42.

Figure 3:
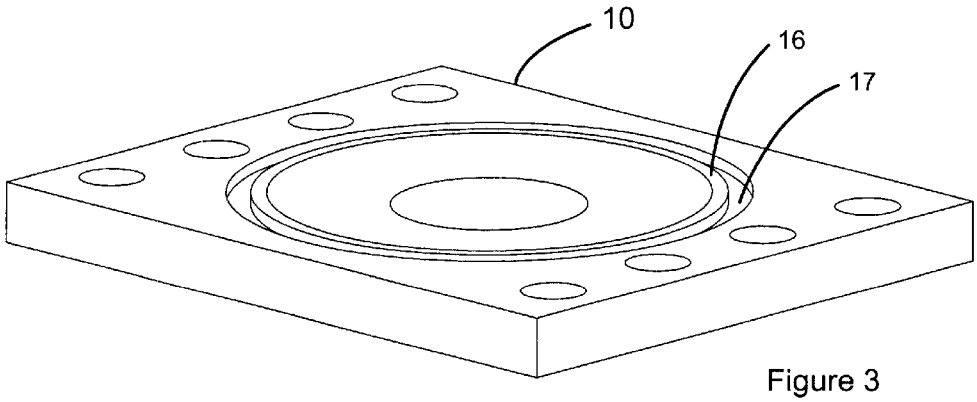
FIG. 3 is an isometric view of the diaphragm plate from the smart material element actuated pump shown in FIG. 1.
Figure 4:
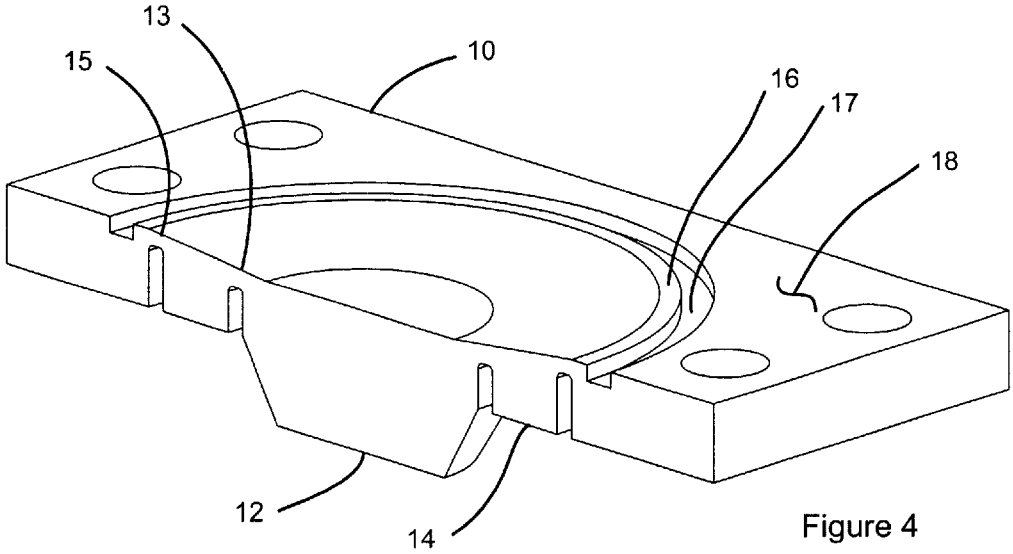
FIG. 4 is a cutaway view of the diaphragm plate shown in FIG. 3.

FIG. 3 further shows diaphragm plate 10 and FIG. 4 shows a cutaway view of diaphragm plate 10. FIG. 4 shows diaphragm plate 10 to be comprised of a center pedestal 12 surrounded on its periphery by a flexure 13. A stiff annular ring 14 surrounds flexure 13 and a second flexure 15 surrounds the stiff angular ring 14. Diaphragm parent plate structure 18 surrounds the second flexure 15. As shown in FIGS. 3 and 4, diaphragm plate 10 is further comprised of face seal surface 16 and o-ring groove 17.

Figure 5:
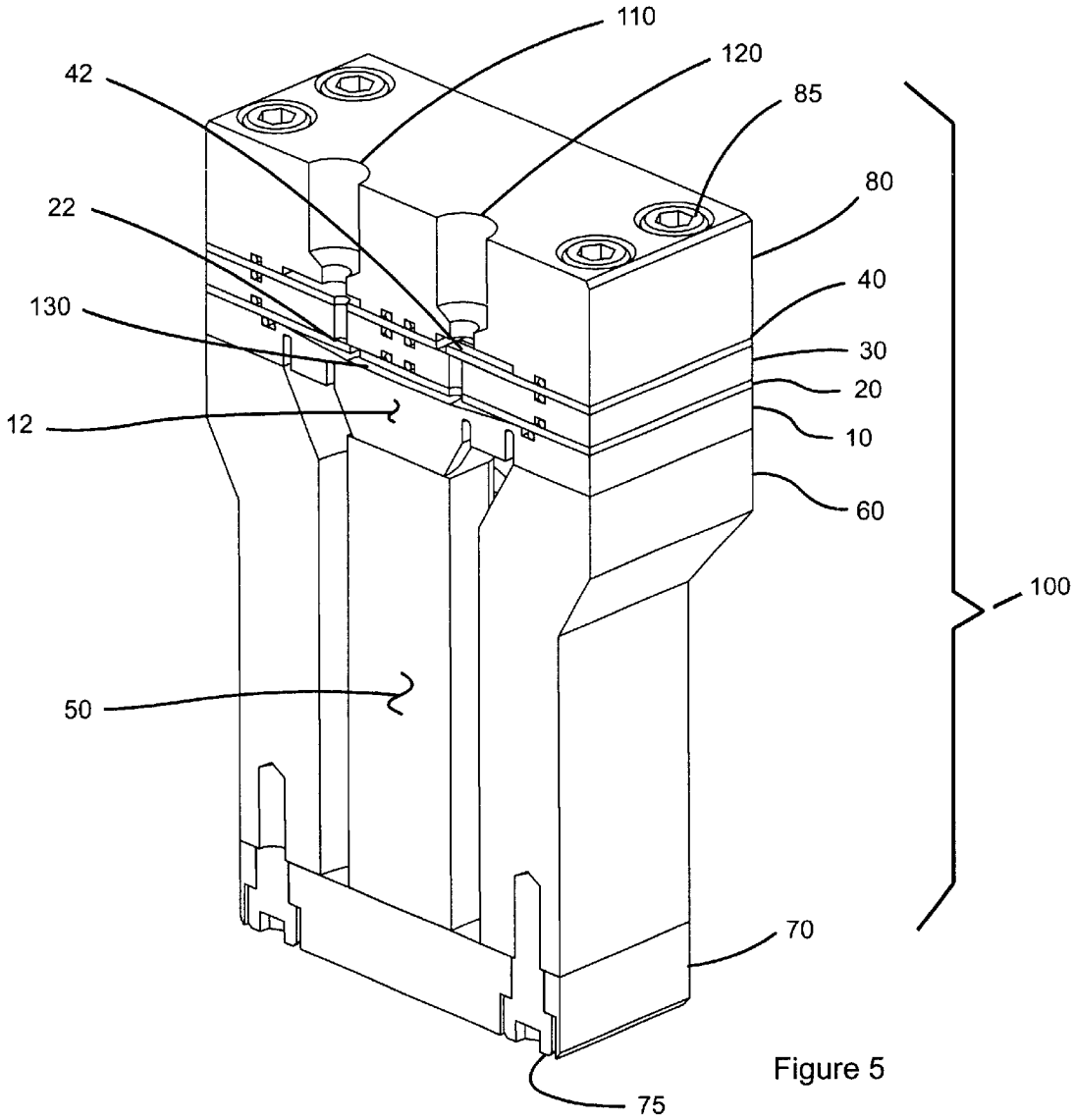
FIG. 5 is a cutaway view of the smart material element actuated pump shown in FIG. 1 in accordance with an embodiment of the invention.

FIG. 5 depicts a cutaway view of the smart material element actuated pump 100. Within the pump 100, chamber 130 is effected between diaphragm plate 10 and inlet valve plate 20. The attributes of the invention, as shown in the embodiment pump 100, are such that the volume of chamber 130 is varied by the lengthening and shortening of smart material element 50 and its forcing of deformation of diaphragm plate 10 through alternating application of an electrical signal to smart material element 50.

The unique construction of the pumping chamber in the invention is such that chamber volume change and consequent pumping occurs without the sliding motion common to piston and sleeve pumps and without the effective compliance of o-ring seals or other compliant seals common to other smart material driven pumps of the prior art. Further the diaphragm plate is constructed such that the bending compliance provided in the two annular flexures provides sufficiently low bending stiffness to the diaphragm but without the unwanted and efficiency wasting compliances of other devices of the prior art. A broad, low profile pump chamber with negligible seal compliance is effected which maximizes the chamber's volumetric efficiency, which in turn maximizes pressure increase and flow during pumping.

Several attributes of the diaphragm plate 10 combine to provide significant performance increases over other smart material driven pumps of the prior art. The flexures 13 and 15 together with the intervening stiff annular ring 14, shown in diaphragm plate 10 depicted in FIGS. 3 and 4, provide for chamber pumping flexibility without unwanted compliances or ineffective chamber volume. In the embodiment shown, flexures 13 and 15 are made by forming two narrow annular cuts in the diaphragm plate 10 on the non-chamber side of the diaphragm plate. Placement of the annular cuts on the non-chamber side of the diaphragm plate avoids the addition of unwanted, unproductive volume within the chamber 130. Further, the shallow, conical-edge shape of the chamber 130 as formed in the diaphragm plate 10 provides for substantially more efficient chamber deformation in terms of the ratio of change in volume over original volume. Further the face-seal surface 16 presses and seals against inlet valve plate 20 to provide a stiff dynamic fluid seal, such that during pumping the compliance associated with o-ring 92 in o-ring groove 17 is not seen by the fluid in chamber 130. O-ring 92 does however serve to prevent fluid seepage between diaphragm plate 10 and inlet valve plate 20 beyond that capability of the face seal surface 16.

The combination of the reed valves 22 in inlet valve plate 20 and reed valves 42 in outlet valve plate 40 with the diaphragm plate 10 further serve to improve the performance of the invention over other smart material actuated pumps of the prior art. The valves 22 and 42 are constructed to be as short as possible and wide as necessary to cover the several internal fluid flow ports within the pump 100. Resonance frequencies of the reed valves are maintained as high as possible, on the order of 1000 Hz and above so that smart material actuation and chamber pumping may occur at comparably high frequencies. Further in the embodiment shown in FIGS. 1 through 5, the passive operational aspect of the reed valves makes for a less costly and more compact design relative to those devices utilizing actively controlled chamber valves. The invention, in other embodiments, may employ actively controlled check valves which are opened and closed in a controlled phase relationship with the diaphragm deformation and/or chamber pumping pressure where further efficiency gains warrant the added cost and complexity.

The reed valves 22 are positioned such that they are free to swing into the chamber 130 during the intake stroke and then spring back against the duct plate 30 for closing of the internal fluid intake ducts in the duct plate 30 during the output stroke. A cavity is formed in top plate 80 such that reed valves 42 are free to swing into that cavity during the output stroke of the pump 100. These valves spring back against the internal fluid output ducts in the duct plate 30 upon stroke completion and chamber pressure relaxation. The high frequency performance of the intake and output valves combine with the shallow, high volumetric efficiency of the chamber 130 to effect a pump well suited to be driven at the very high frequency and short stroke capabilities of smart material elements.

A further important attribute of the pump 100 is the minimal fluid volume outside the pump chamber 130 and upstream of the outlet valves 42 that is pressurized during pump output stroke. The flow output ducting internal to duct plate 30 is minimized so not to significantly diminish the ratio of change in volume to original volume achieved by chamber 130. The thickness of the duct plate 30 is minimized to minimize the length of the outlet duct leading to the outlet valves 42. The area of the outlet ducting within duct plate 30 is sufficiently large so as not to cause a significant pressure drop, but minimized to limit fluid volume outside the chamber 130.

Figure 6:
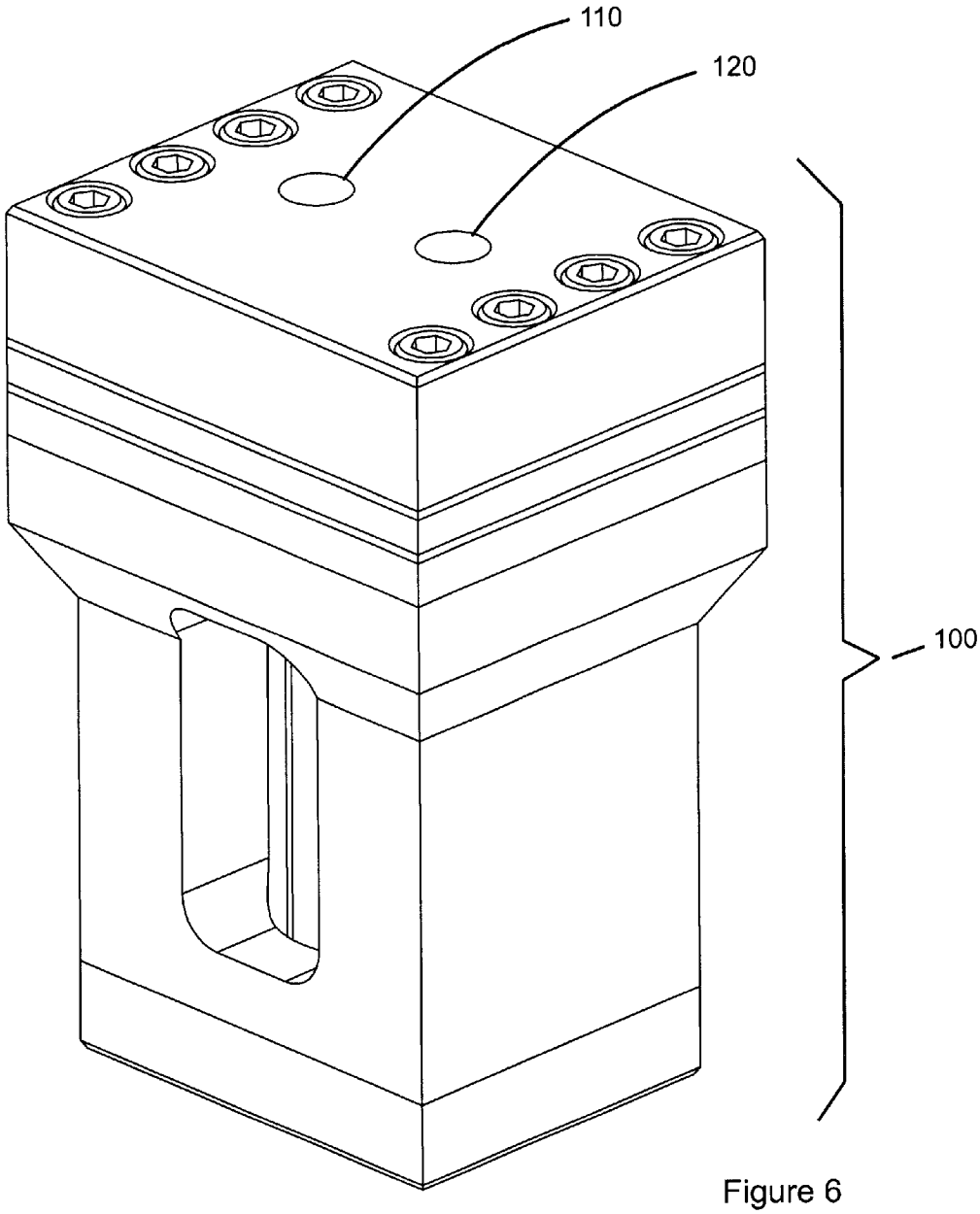
FIG. 6 is an isometric view of the assembled smart material element actuated pump shown in FIG. 1.

FIG. 6 shows the complete assembled view of smart material actuated pump 100. An inlet port 110 and outlet port 120 are shown which provide for fluid supply and return to and from components external to the pump, such as a hydraulic actuator. The multiply stacked plate construction of pump 100 provides for a very compact design and for simple manufacture and assembly. In a further embodiment of the invention a self-contained hydraulic actuator is effected through the direct attachment of a hydraulic actuator to the smart material driven pump 100.

Figure 7:
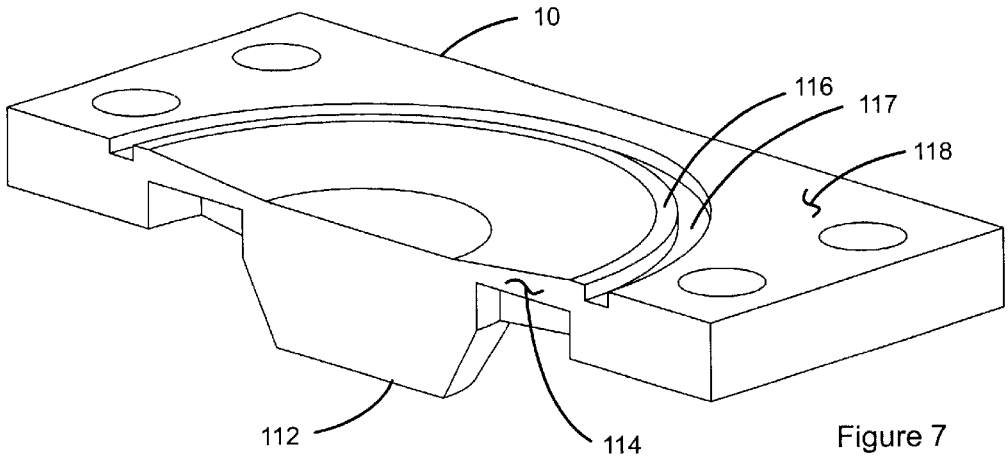
FIG. 7 is a cutaway view of an alternative diaphragm plate in accordance with an embodiment of the invention.

FIG. 7 shows the cross section of a diaphragm plate 10 having an alternate form of flexure means, web 114, in accordance with an embodiment of the invention. Web 114 provides the controlled compliance for allowing stiff center pedestal 112 to move relative to face seal 116 and parent plate structure 118. Face seal 116 provides for a dynamically stiff fluid seal while o-ring groove 117 provides for an o-ring for static fluid sealing.

Figure 8:
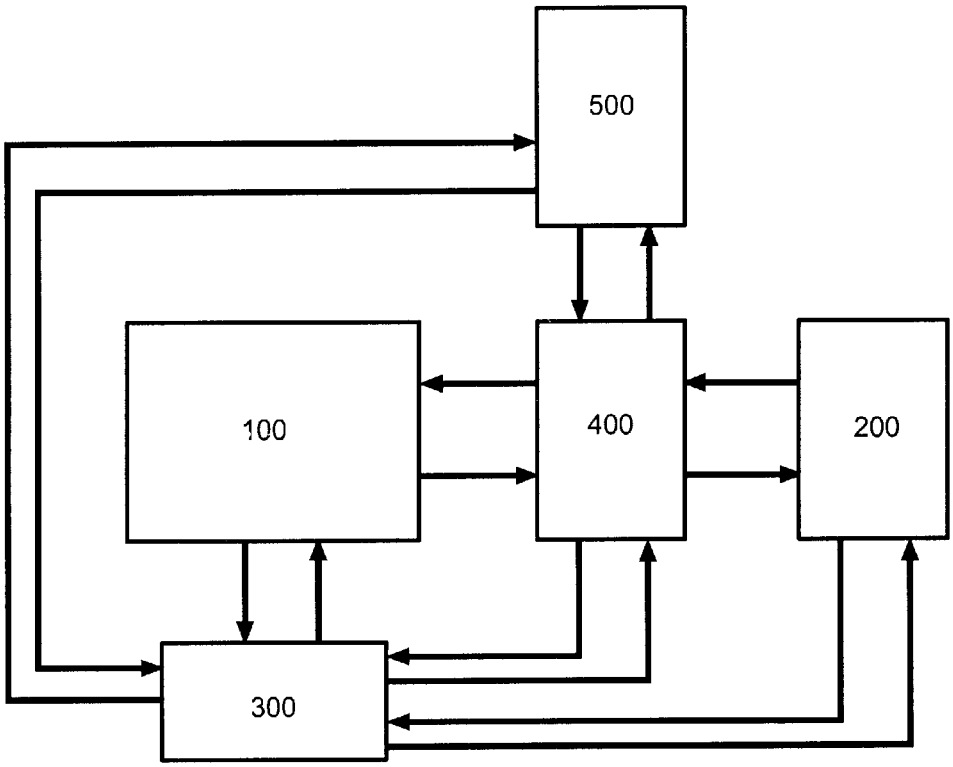
FIG. 8 is a self-contained hydraulic actuation system in accordance with an embodiment of the invention.

FIG. 8 depicts a further embodiment of the invention where a self-contained hydraulic actuation system is effected. The embodiment is comprised of hydraulic pump 100 having an outlet port for providing pressurized hydraulic fluid and an inlet port for drawing in fluid, a directional valve assembly 400 an accumulator 500, and an actuator 200 mounted directly to the hydraulic pump. As described earlier, the hydraulic pump is further comprised of a diaphragm, a face plate coupled to and spanning across the diaphragm, and a smart material element. The diaphragm is further comprised of a recess on the fluid side and a face-seal surface surrounding the recess. The diaphragm is further comprised on its other side of a center pedestal and a flexure means attached to the periphery of the center pedestal. The diaphragm and face plate are coupled together to form a chamber that is dynamically sealed by contact of the face-seal surface against the face plate. Additionally, the smart material element is positioned and constrained against the center pedestal such that extension and contraction of the smart material element deforms the diaphragm such that the chamber compresses and expands through compliance within the flexure means. The embodiment shown in FIG. 8 further comprises an electrical drive and control system 300 wherein the electrical drive and control system regulates an electrical signal, such as a current or voltage signal, which is supplied to the smart material element to regulate the smart material element stroke length and stroke frequency to optimize power output.

In a further embodiment of the invention a pump system is effected through the serial and/or parallel combination of the invention embodiments heretofore described to modify and/or amplify pressure and flow outputs.

Hence, a compact, high efficiency, smart material element driven hydraulic pump is disclosed. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be pre-defined by the claims appended hereto and their equivalents.

What is claimed is:

1. A hydraulic pump comprising:

a diaphragm, a face plate coupled to and spanning across the diaphragm, and a smart material element, wherein the diaphragm further comprises a recess on a first side and a stiff face-seal surface surrounding the recess on the first side and wherein the diaphragm further comprises on a second side a center pedestal and a flexure means attached to the periphery of the center pedestal, and wherein the diaphragm and face plate coupled together form a chamber that is dynamically sealed by contact of the face seal surface against the face plate, and wherein the smart material element is positioned and constrained against the center pedestal such that extension and contraction of the smart material element deforms the diaphragm such that the chamber compresses and expands through compliance within the flexure means.

2. The hydraulic pump of claim 1 wherein the recess is of conical edge shape such that deformation of the diaphragm by the smart material element causes the chamber to flatten against the face plate.

3. The hydraulic pump of claim 1 wherein the smart material element is an element selected from a list comprised of piezoelectric, magnetostrictive, and electrostrictive elements.

4. The hydraulic pump of claim 1 wherein the face plate is further comprised of valves such that the valves direct flow into and out of the chamber in relationship to fluid pressure in the chamber.

5. The hydraulic pump of claim 1 wherein the face plate is further comprised of multiple inlet ports and multiple outlet ports and wherein the valves are reed valves that cover the inlet ports and outlet ports.

6. The hydraulic pump of claim 5 wherein the reed valves are mechanically preloaded in a time controlled manner.

7. The hydraulic pump of claim 1 further comprised of an o-ring wherein the o-ring surrounds the face-seal surface to statically seal the chamber from leakage but does not add effective compliance to the chamber during pumping.

8. The hydraulic pump of claim 1 wherein the face plate is further comprised of actively controlled check valves such that the check valves control flow through inlet and outlet ports in the face plate in phase controlled relationship to fluid pressure in the chamber.

9. The hydraulic pump of claim 1 further comprising an electrical drive and control system wherein the electrical drive and control system regulates an electrical signal supplied to the smart material element to regulate the smart material element stroke length and stroke frequency to optimize power output.

10. A hydraulic pump comprising:

a diaphragm plate, an inlet valve plate a duct plate, an outlet valve plate, and a smart material element, wherein the diaphragm plate is further comprised of a stiff center pedestal connected peripherally to a first annular flexure, wherein the first flexure is connected peripherally to a stiff annular ring, wherein the stiff annular ring is peripherally connected to a second annular flexure, and wherein the second annular flexure is connected peripherally to a parent plate structure, and wherein the diaphragm plate lays against the inlet valve plate which in turn lays against the duct plate such that a pump chamber is effected between the diaphragm plate and inlet valve plate and such that the compliance of the pump chamber effectively consists of the compliance of the first and second annular flexures within the diaphragm plate.

11. The hydraulic pump of claim 10 wherein the diaphragm plate is further comprised of a conical-edged chamber which is surrounded by a face-seal surface such that the face seal surface dynamically seals the diaphragm plate and conical-edged chamber against the inlet valve plate.

12. The hydraulic pump of claim 11 wherein the face-seal surface is surrounded by an o-ring groove and o-ring such that the pump chamber is statically sealed by the o-ring.

13. The hydraulic pump of claim 10 wherein the duct plate lays directly against the outlet valve plate such that fluid within the pump chamber passes out of the chamber when the center pedestal of the diaphragm plate is pressed inward towards the pump chamber and such that fluid is drawn into the pump chamber when the center pedestal moves outward from the pump chamber.

14. The hydraulic pump of claim 10 wherein the inlet valve plate is further comprised of multiple reed valves located over inlet ports within the duct plate.

15. The hydraulic pump of claim 14 wherein the reed valves are mechanically preloaded in a time controlled manner.

16. The hydraulic pump of claim 10 wherein the outlet valve plate is further comprised of multiple reed valves located over outlet ports within the duct plate.

17. A self-contained hydraulic actuation system comprising:

a hydraulic pump having an outlet port for providing pressurized hydraulic fluid and an inlet port for drawing in fluid, a directional valve assembly mounted directly to the hydraulic pump, and an actuator mounted directly to the directional valve assembly, wherein the hydraulic pump is further comprised of a diaphragm, a face plate coupled to and spanning across the diaphragm, and a smart material element, wherein the diaphragm further comprises a recess on a first side and a face-seal surface surrounding the recess on the first side and wherein the diaphragm further comprises on a second side a center pedestal and a flexure means attached to the periphery of the center pedestal, and wherein the diaphragm and face plate coupled together form a chamber that is dynamically sealed by contact of the face-seal surface against the face plate, and wherein the smart material element is positioned and constrained against the center pedestal such that extension and contraction of the smart material element deforms the diaphragm such that the chamber compresses and expands through compliance within the flexure means.

18. The self-contained hydraulic actuation system of claim 17 wherein the recess is of conical edge shape such that deformation of the diaphragm by the smart material element causes the chamber to flatten against the face plate.

19. The self-contained hydraulic actuation system of claim 17 wherein the smart material element is an element selected from a list comprised of piezoelectric, magnetostrictive, and electrostrictive elements.

20. The self-contained hydraulic actuation system of claim 17 wherein the face plate is further comprised of valves such that the valves direct flow into and out of the chamber in relationship to fluid pressure in the chamber.

21. The self-contained hydraulic actuation system of claim 20 wherein the face plate is further comprised of multiple inlet ports and multiple outlet ports and wherein the valves are reed valves that cover the inlet ports and outlet ports.

22. The self-contained hydraulic actuation system of claim 17 further comprised of an o-ring wherein the o-ring surrounds the face-seal surface to statically seal the chamber from leakage but does not add effective compliance to the chamber during pumping.

23. The self-contained hydraulic actuation system of claim 17 wherein the face plate is further comprised of actively controlled check valves such that the check valves control flow through inlet and outlet ports in the face plate in phase controlled relationship to fluid pressure in the chamber.

24. The self-contained hydraulic actuation system of claim 17 further comprising an electrical drive and control system attached directly to the hydraulic pump wherein the electrical drive and control system regulates an electrical signal supplied to the smart material element to regulate the smart material element stroke length and stroke frequency to optimize power output.

* * * * *